US006007432A

United States Patent [19]

Kosmatka

[11] Patent Number: 6,007,432

[45] **Date of Patent: *Dec. 28, 1999**

[54] CONTOURED GOLF CLUB FACE

[75] Inventor: John B. Kosmatka, Carlsbad, Calif.

[73] Assignee: Callaway Golf Company, Carlsbad, Calif.

[ * ] Notice: This patent is subject to a terminal disclaimer.

[21] Appl. No.: 09/120,433

[22] Filed: Jul. 22, 1998

Related U.S. Application Data

[63] Continuation of application No. 08/735,601, Oct. 23, 1996, Pat. No. 5,830,084.

[51] Int. Cl.[6] ..... A63B 53/04

[52] U.S. Cl. ..... 473/324; 473/349

[58] Field of Search ..... 473/324, 330, 473/331, 342, 349, 350, 224, 234, 345

[56] References Cited

U.S. PATENT DOCUMENTS

| | | |
|---|---|---|
| Re. 34,925 | 5/1995 | McKeighen . |
| 4,214,754 | 7/1980 | Zebelean . |
| 4,432,549 | 2/1984 | Zebelean . |
| 4,489,945 | 12/1984 | Kobayashi . |
| 4,511,145 | 4/1985 | Schmidt . |
| 5,028,049 | 7/1991 | McKeighen . |
| 5,060,951 | 10/1991 | Allen . |
| 5,064,197 | 11/1991 | Eddy . |
| 5,074,563 | 12/1991 | Gorman . |
| 5,292,129 | 3/1994 | Long et al. . |
| 5,333,872 | 8/1994 | Manning et al. . |
| 5,344,140 | 9/1994 | Anderson . |
| 5,346,216 | 9/1994 | Aizawa . |
| 5,362,047 | 11/1994 | Shaw et al. . |
| 5,362,055 | 11/1994 | Rennie . |
| 5,377,985 | 1/1995 | Ohnishi . |
| 5,405,136 | 4/1995 | Hardman . |
| 5,405,137 | 4/1995 | Vincent et al. . |
| 5,411,255 | 5/1995 | Kurashima et al. . |
| 5,417,419 | 5/1995 | Anderson et al. . |
| 5,419,559 | 5/1995 | Melanson et al. . |
| 5,429,365 | 7/1995 | McKeighen . |
| 5,447,307 | 9/1995 | Antonious . |
| 5,464,217 | 11/1995 | Shenoha et al. . |
| 5,474,296 | 12/1995 | Schmidt et al. . |
| 5,482,279 | 1/1996 | Antonious . |
| 5,489,094 | 2/1996 | Pritchett . |
| 5,494,281 | 2/1996 | Chen . |
| 5,505,453 | 4/1996 | Mack . |
| 5,601,501 | 2/1997 | Kobayashi . |
| 5,611,742 | 3/1997 | Kobayashi . |

*Primary Examiner*—Sebastiano Passaniti
*Attorney, Agent, or Firm*—Lyon & Lyon LLP

[57] ABSTRACT

A contoured golf club face provides increased structural integrity for a given weight and size is described and shown along with a method for its design. The contoured golf club face includes a vertical stiffening region, a tapered horizontal stiffening region, four similar contoured quadrants of increasingly thinning material toward the center of each quadrant, and thickening regions at face/sole and face/crown intersection regions. The thicknesses of adjoining regions are gradually blended to provide a smooth contoured surface. The present golf club face is light weight, is structurally resistant to impact deformation, is resistant to initial and long-term failure, has its mass center located at its sweet spot, exhibits inertial axes which are aligned with vertical and horizontal axes (i.e. primary club force directions: ball impact force and club centrifugal force directions), and produces acoustical tones. A club incorporating the present contoured golf club face may be provide a certain first acoustical sound when used to hit a ball with a certain first specific area of the face (e.g. the sweet spot or sweet spot region) and to provide a different second acoustical sound when used to hit a ball with an area of the face other than that first area (e.g. other than the sweet spot or sweet spot region). Thus, the present invention may be used to provide an educational tool for use in teaching and/or learning to consistently impact a ball on the optimal region of the club face.

16 Claims, 2 Drawing Sheets

CONTOURED GOLF CLUB FACE

This application is a continuation of co-pending U.S. application Ser. No. 08/735,601, filed Oct. 23, 1996, now U.S. Pat. No. 5,830,084.

FIELD OF INVENTION

The present invention relates to golf clubs, particularly to a golf club face which has a contoured surface opposite its hitting surface.

BACKGROUND

Generally, a golf club comprises a shaft portion, a head portion, and a grip portion. That part of the golf club head portion which outlines or defines a hitting surface is called a golf club face. See, e.g., R. Maltby, "Golf Club Design, Fitting, Alteration & Repair" (4th Ed. 1995). Generally, a club face abuts or is adjacent to both a crown (or top portion) of the club head and a sole (or bottom portion) of the club head.

In hollow metal wood type club heads and cavity backed iron type club heads the golf club faces are preferably thin. Such golf club faces generally define two surfaces: a hitting (or front) surface and a back surface which is opposite the hitting surface.

When the face of a golf club head strikes a golf ball, large impact forces (e.g. up to 2000 pounds) are produced. These large impact forces load the club face. In the relatively thin faces of hollow metal wood type club heads and cavity backed iron type club heads these forces tend to produce large internal bending stresses. These internal bending stresses often cause catastrophic material cracking which causes the club head to be unusable.

Recent computational and experimental studies on hollow metal wood type club heads and cavity backed iron type club heads have shown that such catastrophic material cracking most often occurs in at least one of the following three face locations: (1) in the head face hitting surface at the ball strike center which is an area of large compressive bending stresses, particularly in the area of any score-lines; (2) on the back surface of the head face at the ball strike center which is an area of large tensile bending stresses; and (3) (a) at the portion of the intersection of the face and the crown which lies directly above the ball strike center which is an area of large vertical component of the bending stresses, and/or (b) the intersection of the face and the sole which lies directly below the ball strike center which also is an area of large vertical component of the bending stresses. The region between the face/crown intersection above the ball strike center and the face/sole intersection below the ball strike center may be called a ball strike zone.

It has also been found that the vertical stress distribution through the ball strike zone on the back side of the face comprises large compressive (i.e. negative) stresses in the face/sole intersection region which increase to zero toward the ball strike center region, reach a maximum tension (i.e. positive) value behind the ball strike center region, decrease through zero to large compressive (i.e. negative) stresses toward the face/crown intersection region. The vertical stress distribution through the ball strike zone on the front side (or hitting surface) of the face generally has the same, but opposite, components (i.e. large tension bending stresses at face/sole intersection which decrease to large compressive stresses at ball strike center and then increase to large tension bending stresses at face/crown intersection).

In designing golf club heads, the golf club face portion must be structurally adequate to withstand large repeated forces such as those associated with ball impact. Such structural adequacy may be achieved by increasing the face portion stiffness so that the bending stress levels are below the critical stress levels of the material used in the face. Typically, for metal club heads, the face portions are stiffened by uniformly increasing the thickness of the face portion and/or by adding one or more ribs (i.e. discrete attached posts or metal lines) to the back surface of the face.

Uniformly increasing the thickness of the face portion typically requires the addition of a large amount of material to adequately reduce the stress sufficient to prevent impact and/or fatigue cracking. However, the addition of such a large amount of material to a club face generally adversely affects the performance of a club incorporating such a face. The club performance is adversely affected by the overly heavy club head which has a mass center (i.e. center of gravity) which is too close to the club face thereby affecting optimum performance. In addition, the feel and sound of a club incorporating such a face is also adversely affected by the large number of vibrations transmitted through the club and by the acoustic response of the club.

Adding ribs to the back surface of a face to stiffen the face has the benefit of stiffening without adding a significant amount of weight to the face, but has the detrimental result of creating an irregular stiffness distribution on the face hitting surface. Examples of ribs which have been used in prior metal golf club head designs include, for example, vertical ribs, horizontal ribs, curved ribs, dendritic ribs, angled or skewed (i.e. V or X patterned) ribs, circular ribs, or a combination of more than one of these types. Such ribs are generally geometrically characterized as having a narrow width, any desired length, and a sufficient depth or thickness to locally increase the face stiffness and yet minimize the increase in face weight.

In addition, such ribs are typically shaped such that a sharp corner (or a curved corner with a small radii) is formed between a rib and the face back surface where the rib is attached. Such corners lead to cracking potential. Furthermore, the use of ribs which are positioned to run vertically along the face back surface cause the large bending stresses (which were described above) to travel to the face/sole and face/crown intersections thereby increasing cracking at those positions.

Additional problems experienced with the use of ribs on a face back surface are in the manufacture of such faces. Typically faces are formed using a casting process. It is more difficult to cast faces which include rib structures due to nonuniform material shrinkage which occurs during cool-down of such a casting. Such non-uniform cool-downs tend to cause inclusions, internal voids, and/or surface cracking in the cast materials, particularly along regions where ribs are positioned. Such non-uniform cool-downs also tend to cause face depressions and surface dimpling in the hitting surface opposite the regions where ribs are positioned.

Thus, there is a need for a new club face structure with increased structural integrity (and, thereby, reduced cracking and material failure) without adversely affecting club performance, look, feel, and sound.

SUMMARY OF THE INVENTION

The present invention comprises a contoured golf club face which addresses the problems previously described and a method of designing such a golf club face. The present contoured golf club face provides increased structural integrity for a golf club face of a given size and weight. The present contoured golf club face survives tests in which other club faces experience cracking and/or material failure. The present contoured golf club face does not adversely affect golf club performance, look, feel, and/or sound, but rather improves the same due to its ability to provide a golf club face having a required size and strength with a smaller amount of material (and, accordingly, a lower weight), and its ability to be acoustically tuned to provide a desired acoustical effect. Indeed, the present contoured golf club face may be "tuned" to provide certain acoustical effects when a ball is hit by the hitting surface at certain preferred points and different acoustical effects when a ball is hit by the hitting surface at points other than the preferred points.

The present contoured golf club face preferably comprises a golf club face having a flat hitting surface and a contoured back surface opposite the hitting surface. Such a contoured back surface could also be described as a surface of increasing and decreasing thickness having the appearance of hills and valleys. The present contoured golf club face preferably provides a low-weight face which provides the face center of mass at the sweet spot and the face principal inertia axes in the directions of the primary club forces.

The contoured back surface preferably comprises a vertical stiffening region and a horizontal stiffening region which define four quadrants (or contoured regions) on the face back surface. The vertical stiffening region preferably is generally located along a vertical central axis of the back surface and has a certain preferable thickness. The horizontal stiffening region preferably is generally located along a horizontal central axis of the back surface and has a certain preferable thickness which preferably tapers (i.e. becomes thinner) toward extremities of the axis. The four quadrants defined by the vertical and horizontal regions preferably are generally similarly shaped and provide thinned contoured regions surrounded by (and gradually blended into) increasingly thicker regions such that the thickest regions are toward the circumferential edges of each quadrant. Thus, when all four quadrants are viewed together as the club face, the thickest regions are along the vertical and horizontal central axes of the club face, the regions having the next largest thickness are along the circumferential edges of the club face, and the thinnest regions are surrounded by progressively thicker regions gradually blended to the thickest and next largest thickness regions thereby providing a contoured surface.

When the club face is viewed further, additional thickened areas are provided along circumferential edges of the club face such that thickened portions are provided at face/sole and face/crown intersections when the club face is incorporated into a club head.

The benefit of such a contoured golf club face is that for a given size club face its stiffness and structural integrity are increased while its weight is reduced. An additional benefit of such a contoured golf club face is that a golf club head incorporating such a face will have certain acoustical properties depending on the size(s) of the contoured regions. In addition, such acoustical properties may be manipulated by manipulating the size(s), shape(s), and/or depth(s) of the contoured regions.

It is, therefore, a primary object of the present invention to provide a new golf club face which provides increased strength and integrity with reduced weight and materials for a given size club face and a method of designing the same.

It is an additional object of the present invention to provide a golf club face which is contoured to provide a golf club face having varying thickness and a method of designing the same.

It is a further object of the present invention to provide a golf club face which is contoured to provide thick regions along vertical and horizontal axes of the face, thinner regions along areas abutting face/crown and face/sole intersections, and thinnest regions in areas surrounded by progressively thicker regions which blend to the thick and thinner regions.

It is also an object of the present invention to provide a low-weight golf club face which provides the face center of mass aligned at the center of the sweet spot or region providing sweet-spot-like behavior or performance (i.e. providing optimal ball travel and trajectory) of the face.

It is another object of the present invention to provide a golf club face which provides the face principal inertia axes in the directions of the primary club forces (i.e. ball impact force direction and club centrifugal force direction).

It is yet another object of the present invention to provide a golf club face which includes features which may be adjusted to tune the acoustical properties of a golf club head incorporating the golf club face.

It is still another object of the present invention to provide a structurally stiff club face which is resistant to impact deformation and a method of designing the same.

It is still a further object of the present invention to provide a golf club face with overall lower impact induced stresses and which is more resistant to initial and long-term failures and a method of designing the same.

Other objects and features of the present invention will become apparent from consideration of the following description taken in conjunction with the accompanying drawings.

DETAILED DESCRIPTION OF THE PREFERRED EMBODIMENT

Figure 1:
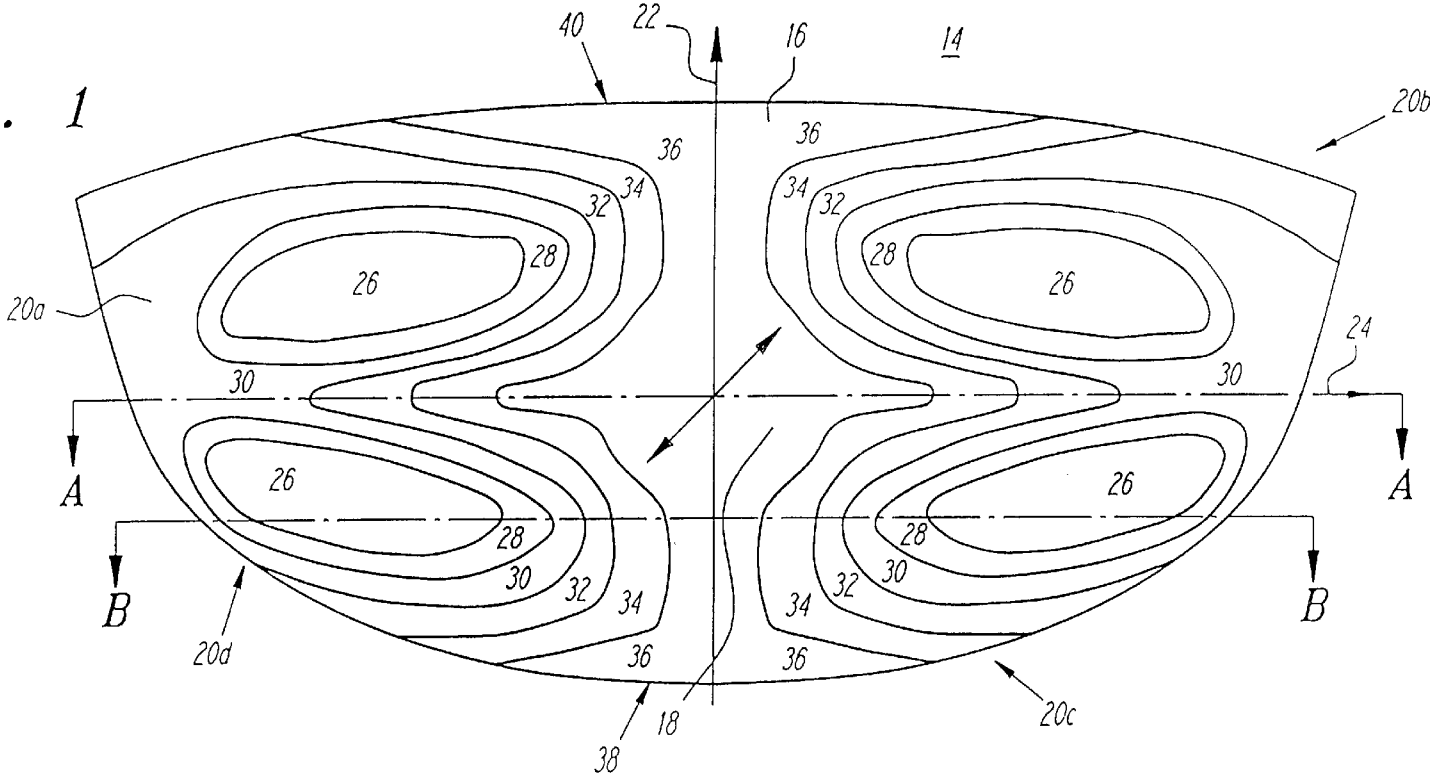
FIG. 1 shows a plan view of a back surface of a golf club face of the present invention.

As is described above and shown in FIGS. 1–3, a golf club face 10 of the present invention comprises a substantially smooth front hitting surface 12 (shown in FIGS. 2A and 2B only), which may include score-lines (not shown), and a contoured back surface 14 which preferably comprises a vertical stiffening region 16 and a horizontal stiffening region 18 which together define four quadrants (or contoured regions) 20*a–d* on the face back surface 14.

Figure 2A:
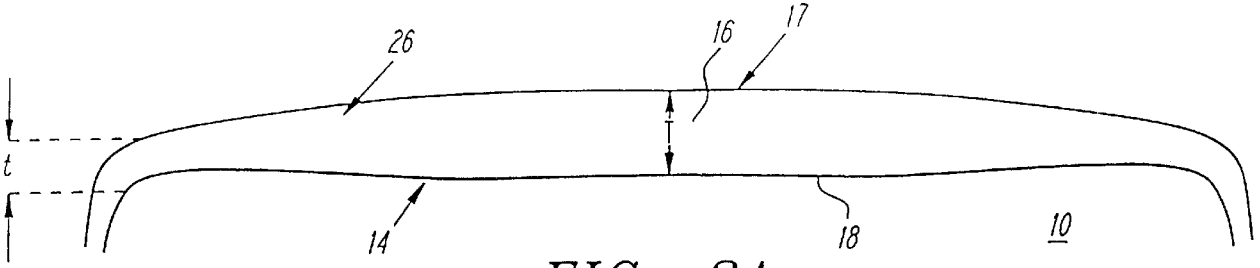
FIG. 2A shows a cross-sectional view of a golf club face of the present invention taken along line A—A in FIG. 1.
Figure 2B:
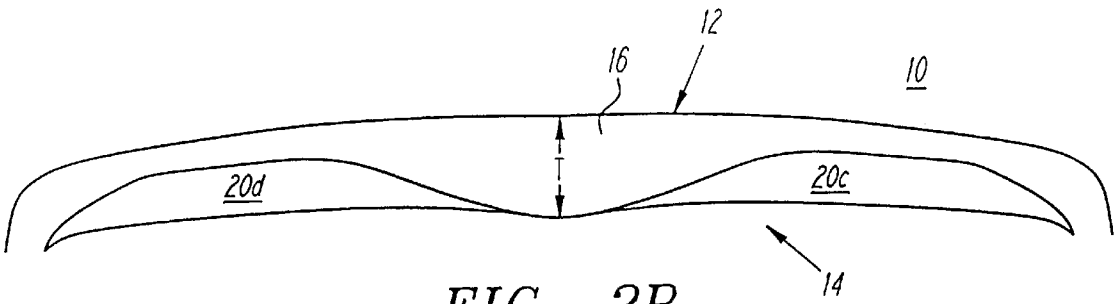
FIG. 2B shows a cross-sectional view of a golf club face of the present invention taken along line B—B in FIG. 1.
Figure 3:
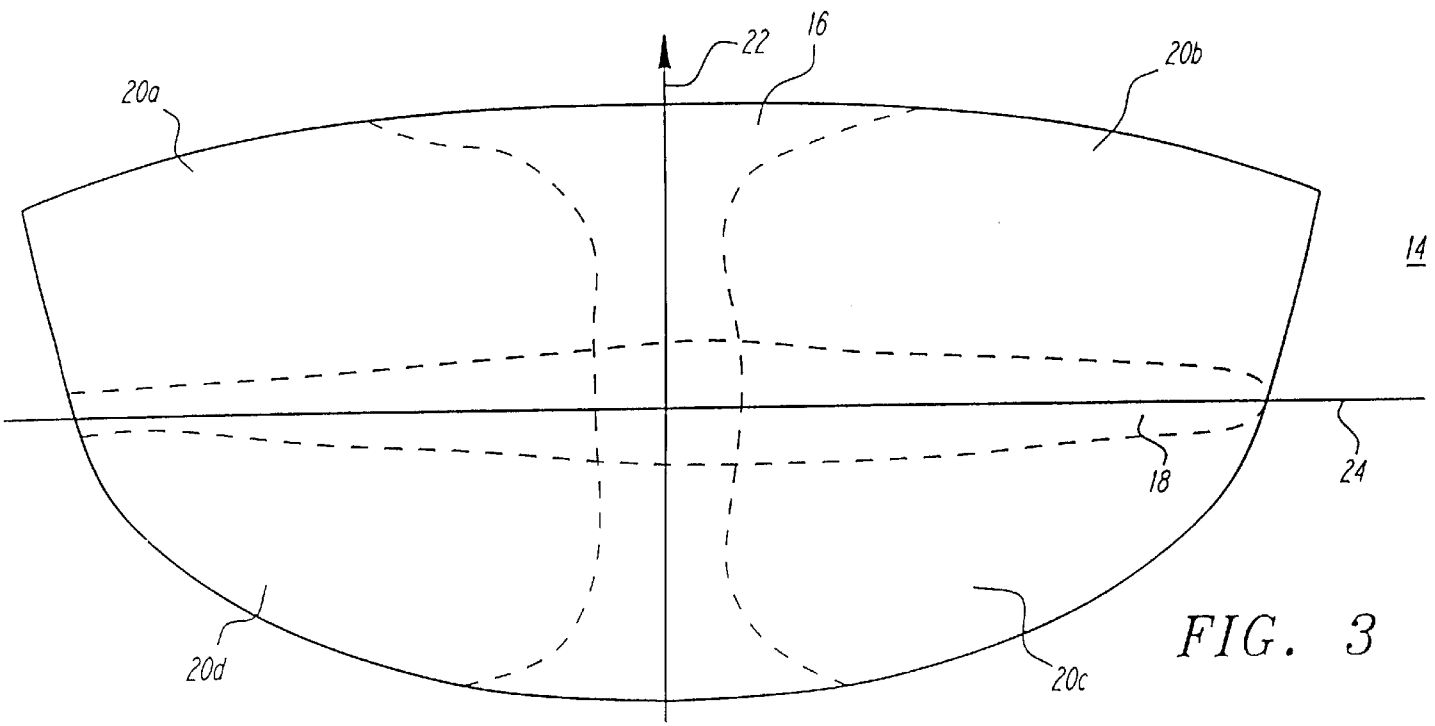
FIG. 3 shows a plan view of a back surface of a golf club face of the present invention generally showing outlines of vertical and horizontal stiffening regions.

As is shown in FIG. 1, the vertical stiffening region 16 preferably is generally located substantially along a vertical central axis 22 of the back surface 14 and has a certain preferable thickness T (shown in FIGS. 2A and 2B). The horizontal stiffening region 18 preferably is generally located along a horizontal central axis 24 of the back surface 14 (shown in FIG. 1) and has a certain preferable thickness T which referably tapers to a thickness t toward extremities of the axis 24 (shown in FIG. 2A).

As is also shown in FIG. 1, the four quadrants 20*a–d* defined by the vertical and horizontal stiffening regions 16 and 18 preferably are generally similarly shaped and provide contours comprising thinnest regions 26 surrounded by (and gradually blended into) increasingly thicker regions 28, 30, 32, 34, 36 such that the thickest regions 32, 34, 36 are toward the circumferential edges of each quadrant. As is described in greater detail below, each of these four thinnest regions 26 can each be tuned to provide an acoustical response distinct from the others. Thus, when all four quadrants are viewed together as the club face, the thickest regions 36 are along the vertical and horizontal central axes 22, 24 of the club face (i.e. are along the vertical and horizontal stiffening regions 16, 18), the regions having the second and third largest thicknesses 32, 34 are along the circumferential edges of the club face, and the thinnest regions 26 are surrounded by increasingly thick regions 28, 30, which blend into the thickest and next thick regions 32, 34, 36. While the preferred embodiment presently shown and described include gradually thicker regions, any number of regions of increasing thickness may be used and are sought to be covered herein. It should be recognized that the present description is limited by the ability to show a large number of gradually thicker regions over a contoured area. In addition, while the presently preferred embodiment shown in FIG. 1 shows the increasingly thick regions as discrete separate sections, it should be understood that the thicknesses of these regions are gradually blended, so a finished club face has a smooth contoured surface (as shown in FIG. 2B) as opposed to a stepped surface.

When the club face is viewed further, thickened areas 32, 34, 36 are provided along circumferential edges of the club face back surface 14 such that these thickened areas 32, 34, 36 are provided at face/sole and face/crown intersection portions 38, 40, as shown in FIG. 1.

Exemplary specific thicknesses for the regions shown in FIG. 1 for a club face made of titanium alloy Ti-6Al-4V (commonly referred to as "titanium 6-4") are: (1) region 26 is about 0.120 inches; (2) region 28 tapers from about 0.120 to about 0.125 inches; (3) region 30 tapers from about 0.125 to about 0.130 inches; (4) region 32 tapers from about 0.130 to about 0.135 inches; (5) region 34 tapers from about 0.135 to about 0.140 inches; and (6) region 36 tapers from about 0.140 to about 0.150 inches. Exemplary specific width and height for such a club head face are a width of about 3.25 inches as measured along the horizontal axis 24 in FIG. 1, and a height of about 1.75 inches as measured along the vertical axis 22 as in FIG. 1. However, those of ordinary skill in the art understand that to provide club faces with similar structural integrity and performance, the thicknesses and dimensions of the club faces will differ from these exemplary values depending on the metals or alloys used and the physical properties of the same, and the particular size and shape of the desired club face.

An exemplary embodiment of the present invention comprises a golf club face 10 which is shown in cross-section in FIGS. 2A and 2B and which preferably has an even hitting surface 12 (which may include score-lines (not shown)) and a contoured back surface 14 which is opposite the hitting surface 12. The preferred club face 10 of the present invention provides a structurally "efficient" metal golf club face having increased strength and reduced weight for a given face size.

The club face design of the present invention has a significantly lower face weight than a similarly strong club face which has a uniform thickness (which is described above), thereby resulting in a club which has better playability (by achieving a target swing weight) and more distinct acoustical characteristics. The club face design of the present invention also has a more uniform face stiffness distribution than a club face which incorporates ribs on its face back surface, as described above.

In addition, the club face design of the present invention is more structurally efficient than prior designs, thereby eliminating common structural failures and flaws associated with manufacturing such as, for example, casting, welding, and/or shrinkage. Further, the club face design of the present invention has increased structural resiliency for a given ball impact whereby, as a result of the design, the stresses are lower (1) in the face hitting surface at the ball strike center, particularly in the area of any score-lines; (2) on the back surface of the head face at the ball strike center; and (3) at the face/crown and face/sole intersections which, respectively, lie directly above and below the ball strike center. The club face design of the present invention further provides a more uniform face stiffness over a larger area thereby insuring that balls hit off- center will still experience more uniformly stiff face surface and thereby react as if hit on-center (i.e. a larger sweet spot or sweet spot region or region providing optimal ball travel and trajectory is provided) and will not detrimentally affect the club face structurally.

Furthermore, the club face design of the present invention provides acoustical properties which may be tuned to give a first sound when balls are hit with an optimal region of the face and a different second sound when balls are hit with areas of the face other than the optimal region, thereby providing the user of the club instant feed back and the ability to adjust his or her swing accordingly. Such differing acoustical responses from the club face of the present invention enables such a face to be used as an educational tool for teaching and/or learning to consistently impact a ball on the optimal region (i.e. the sweet spot or sweet spot region) of the club face.

The present design for a contoured face of the present invention was achieved by first performing a detailed computational structural analysis of the proposed head geometry for a series of different simulated ball impacts to determine the following: (1) for a sweet spot (or sweet spot region) hit, the bending stresses are largest in the sweet spot region and in face/sole and face/crown interface regions, whereas the stresses in the toe and heel regions are near zero; (2) for miss hits (i.e. hits off of the sweet spot or sweet spot region), bending stresses are highest at the ball impact center and directly above and below the ball impact center at the face/crown and face/sole intersection regions; (3) effective face flexibility significantly decreases off-center due to the reduction in face width (i.e. there are drastic flexibility changes when you move off of the sweet spot or sweet spot region); and (4) for almost all hits there were regions in which bending stresses were low and, therefore, regions from which material (and weight) could be removed without adversely affecting the structural integrity of the face. The results of these studies are equally applicable to both hollow metal wood type club heads and cavity backed iron type club heads.

Based on these results and as is described above, the present head face was designed to have a thick vertical stiffening region 16 (shown in FIG. 1) under the face sweet spot or sweet spot region along a vertical axis 22 with increasing width at face/sole and face/crown intersecting regions 38, 40 to insure that bending stresses safely disperse into the head sole and crown regions. The thickness T (shown in FIGS. 2A and 2B) of the vertical stiffening region 16 was adjusted so that the stress experienced in these regions was below the maximum stresses tolerable by the material.

As is also described above, the present head face was also designed to have a horizontal stiffening region 18 (shown in FIG. 1) along a horizontal axis 24 which has a certain preferable thickness which preferably tapers (i.e. becomes thinner) toward extremities of the axis 24 to increase the face flexibility in toe and heel regions to increase the size of the effective sweet spot or sweet spot region.

As is mentioned above, the vertical and horizontal stiffening regions 16, 18 define four quadrant regions 20*a–d* which, as was determined by the above-described study results, are areas of low stress. In the present design, the four quadrant regions 20*a–d* are thinned (compared to the vertical and horizontal regions 16, 18) to reduce the face weight. These thinned areas 20*a–d* have the added benefit of being capable of being designed to produce local low frequency vibration modes which emit pleasing acoustical tones. Due to this added benefit, a face may be designed such that when a ball is hit on the sweet spot or sweet spot region of the face all four quadrants 20*a–d* are uniformly excited and vibrate to emit pure and clean acoustic tones preferably within the range of human hearing. The face may be further designed such that each of the quadrants is tuned to provide a distinct acoustical response and, therefore, when a ball is hit on an area other than the sweet spot or sweet spot region of the face at least one of the quadrants 20*a–d* will be muffled by the ball strike thereby causing less than all four quadrants to be uniformly excited which thereby causes emission of acoustic tones different than that produced from a sweet spot or sweet spot region hit.

This added benefit of acoustic feed-back upon hitting a ball with the contoured golf club face of the present invention allows a club incorporating the same to be used as an educational tool to assist in the instruction and/or learning of consistently impacting a ball on the optimal region of the club face.

While an embodiment of the present invention has been shown and described, various modifications may be made without departing from the scope of the present invention, and all such modifications and equivalents are intended to be covered. For example, in our design the preferred stiffening regions are shown as corresponding to horizontal and vertical axes of the club face. However, in an equivalent design such stiffening regions could be based on a pattern other than one corresponding to such axes (e.g. a pattern wherein the stiffening regions are off-set from the horizontal and vertical axes or a pattern wherein the stiffening regions are not approximately perpendicular or a pattern wherein there are more than two or three main stiffening regions). In further example, an equivalent method would be to design a contoured club face based upon a given stress load even if the resulting contours are different than that described as preferred here.

What is claimed is:

1. A golf club face comprising a vertical stiffening region located along a vertical central axis of the face, wherein the vertical stiffening region has a first thickness, and a horizontal stiffening region located along a horizontal central axis of the face, wherein the horizontal stiffening region has the first thickness proximal the vertical central axis and a second thickness distal from the vertical central axis, wherein the first thickness is thicker than the second thickness.

2. The golf club face of claim 1 further comprising a face/crown stiffening region located along a face/crown intersecting edge of the face, wherein the face/crown stiffening region has the first thickness proximal the vertical central axis and a third thickness distal from the vertical central axis, wherein the first thickness is thicker than the third thickness, and a face/sole stiffening region located along a face/sole intersecting edge of the face, wherein the face/sole stiffening region has the first thickness proximal the vertical central axis and a fourth thickness distal from the vertical central axis, wherein the first thickness is thicker than the fourth thickness.

3. The golf club face of claim 2 further comprising four thinned regions, wherein one thinned region is located in a quadrant, wherein each quadrant has a first edge defined by the vertical stiffening region, a second edge defined by the horizontal stiffening region, and third and fourth edges defined by circumferential edges of the face, wherein each of the thinned regions has a fifth thickness proximal a central portion of the quadrant, a first thickness proximal the first edge, first and second thicknesses proximal the second edge, first and third thicknesses proximal the third edge, and first and fourth thicknesses proximal the fourth edge, wherein the first, second, third, and fourth thicknesses are thicker than the fifth thickness.

4. The golf club face as in claim 3 wherein each of the thinned regions is tuned to vibrate at a certain specific frequency when vibrationally excited by the golf club face hitting a golf ball.

5. A golf club head comprising a golf club face as in claim 3.

6. A golf club comprising a golf club head as in claim 5.

7. The golf club of claim 6 wherein the golf club head emits a first acoustical tone upon hitting a golf ball with the sweet spot region of the golf club face and a second acoustical tone upon hitting a golf ball with a region of the golf club face other than the sweet spot region.

8. A golf club face comprising a ball hitting surface, and a back surface which is opposite the ball hitting surface, wherein the back surface is contoured to give the face more than one thickness, wherein the thickness of the face at a given location is proportional to the bending stresses experienced by the given location of the face upon a force being applied to the ball hitting surface.

9. The golf club face of claim 8 wherein the more than one thickness is gradually blended between different thicknesses to provide a smoothly contoured back surface.

10. A golf club head comprising a golf club face as in claim 8.

11. A golf club face comprising a ball-hitting surface, and a back surface which is opposite the ball-hitting surface, wherein the back surface is contoured to give the face two or more thicknesses, wherein regions of the face which experience a similar magnitude of stress load upon a force being applied to the ball-hitting surface have similar thicknesses, and wherein the back surface is smoothly contoured between regions of differing thickness.

12. A golf club head comprising a golf club face as in claim 11.

13. The golf club face of claim 11 wherein the magnitudes of stress load are due to a plurality of ball impacts at a plurality of locations on the ball hitting surface.

14. The golf club face of claim 1 wherein the thickness of the face tapers from the first thickness to the second thickness.

15. The golf club face of claim 2 wherein the thickness of the face is smoothly contoured between the first, second, third and fourth thicknesses.

16. The golf club face of claim 3 wherein the thickness of the face is smoothly contoured between the first, second, third, fourth and fifth thicknesses.

* * * * *